US006348865B1

(12) United States Patent
Siegel

(10) Patent No.: US 6,348,865 B1
(45) Date of Patent: Feb. 19, 2002

(54) ANTI-THEFT ELEMENT

(75) Inventor: Georg Siegel, Bergkamen (DE)

(73) Assignee: Georg Siegel Gesellschaft mit beschränkter Haftung zur Verwertung von gewerblichen Schutzrechten, Kamen (DE)

( * ) Notice: Subject to any disclaimer, the term of this patent is extended or adjusted under 35 U.S.C. 154(b) by 0 days.

(21) Appl. No.: 09/623,198

(22) PCT Filed: Dec. 29, 1999

(86) PCT No.: PCT/EP99/10440

§ 371 Date: Oct. 5, 2000

§ 102(e) Date: Oct. 5, 2000

(87) PCT Pub. No.: WO00/39766

PCT Pub. Date: Jul. 6, 2000

(30) Foreign Application Priority Data

Dec. 29, 1998 (DE) ..... 298 23 167 U

(51) Int. Cl.[7] ..... G08B 13/14

(52) U.S. Cl. ..... 340/572.1; 340/572.6; 340/572.8

(58) Field of Search ..... 340/572.1, 572.8, 340/572.5, 572.6

(56) References Cited

U.S. PATENT DOCUMENTS

| | | | | |
|---|---|---|---|---|
| 4,510,489 A | | 4/1985 | Anderson, III et al. | 340/572 |
| 4,510,490 A | * | 4/1985 | Anderson, III et al. | 340/572 |
| 4,965,689 A | * | 10/1990 | Normann et al. | 360/131 |
| 5,495,230 A | * | 2/1996 | Lian | 340/551 |
| 5,594,420 A | * | 1/1997 | Copeland et al. | 340/572 |

FOREIGN PATENT DOCUMENTS

| | | |
|---|---|---|
| WO | WO 90/03652 | 4/1990 |

* cited by examiner

*Primary Examiner*—Daniel J. Wu
*Assistant Examiner*—Sihong Huang
(74) *Attorney, Agent, or Firm*—Smith, Gambrell & Russell, LLP

(57) ABSTRACT

In order to largely protect an anti-theft element for acoustomagnetic anti-theft systems which contains a module that is accommodated in a housing and has a magnetic element as well as a thin metal plate from manipulations, in particular, deactivation by strong magnetic fields, without a noteworthy enlargement of the structural size, the invention proposes to realize the magnetic element in the form of magnetic foils that are polarized with a north pole alignment and a south pole alignment, respectively.

7 Claims, 1 Drawing Sheet

ANTI-THEFT ELEMENT

BACKGROUND OF THE INVENTION

The invention pertains to an anti-theft element for acoustomagnetic security systems, with said anti-theft element containing a module that is arranged in a housing and consists of at least one magnetic element and a thin metal plate.

Anti-theft elements of this type which are used in so-called acoustomagnetic systems and also referred to as AM labels are generally known and broadly utilized. They serve for identifying the merchandise, onto which such labels are applied or into which such labels are incorporated.

Known AM labels consist of a plastic housing, a thin metal plate and a thin magnetic plate. The magnetic plate has a north-south polarization, and the metal plate is positioned at an exactly defined distance from the magnetic plate. The dimensions of both plates are exactly predetermined. The tolerances lie on the order of tenths of a millimeter.

Acoustomagnetic system locks which consist of transmission and reception units detect the resonance at a frequency of approximately 58 kHz of such labels and trigger. In order to prevent the triggering of such labels, high ac currents are generated by means of large copper coils in order to erase the north-the south pole structure on the magnetic strips. Due to this measure, the acoustomagnetic system locks no longer respond.

However, labels of this type can also be very easily manipulated, e.g., by means of malicious deactivation.

Certain areas are particularly susceptible to theft, e.g., CD departments of department stores, music stores and the like. In this case, another system is used instead of labels that can be deactivated, with the labels being arranged in so-called safers that remains in the store. However, the anti-theft systems can also be manipulated in this case by exerting pressure, mechanical bending or the previously described erasing of the polarization of the magnetic strips.

SUMMARY OF THE INVENTION

In light of the previously described state of the art, the present invention is based on the objective of making available an anti-theft element which largely precludes manipulations without enlarging the structural shape of the element.

According to the invention, this objective is attained by additionally developing an anti-theft element of the initially described type in such a way that it cannot be deactivated, i.e., the anti-theft element is realized such that it remains permanently activated.

This objective is attained due to the fact that flexible magnetic foils are accommodated in the label housing with different pole alignments such that the standard magnetic plate can be eliminated. It was surprisingly determined that flexible magnetic strips, namely one magnet strip with a north pole alignment and one magnetic strip with a south pole alignment which are arranged on opposite sides of the label, can be adjusted to a frequency of approximately 58 kHz together with the metal plate. In this respect, the dimensions of the magnetic strips and their distance from the metal plate are important. It proved to be particularly advantageous to utilize strips of magnetic foil with a height of approximately 1.4 mm, a length of approximately 1.5 cm and a width of approximately 2 mm. These strips are arranged on diagonally opposite sides of the labels. It was surprisingly determined that labels of this type can no longer be deactivated with conventional deactivation units.

Such permanently active labels consequently are particularly suitable for systems, in which the anti-theft element remains within a secured area. This means that special housings, so-called safers, can be provided with labels according to the invention such that the safer labels can no longer be manipulated. This results in an increased security. The structural shapes are not enlarged, with miniaturized versions of the label also being possible. The manufacturing expenditure is maintained at a low level.

DESCRIPTION OF THE DRAWINGS

Additional advantages and characteristics of the invention result from the following description of the figures. The figures show.

DESCRIPTION OF THE INVENTION

Figure 1:
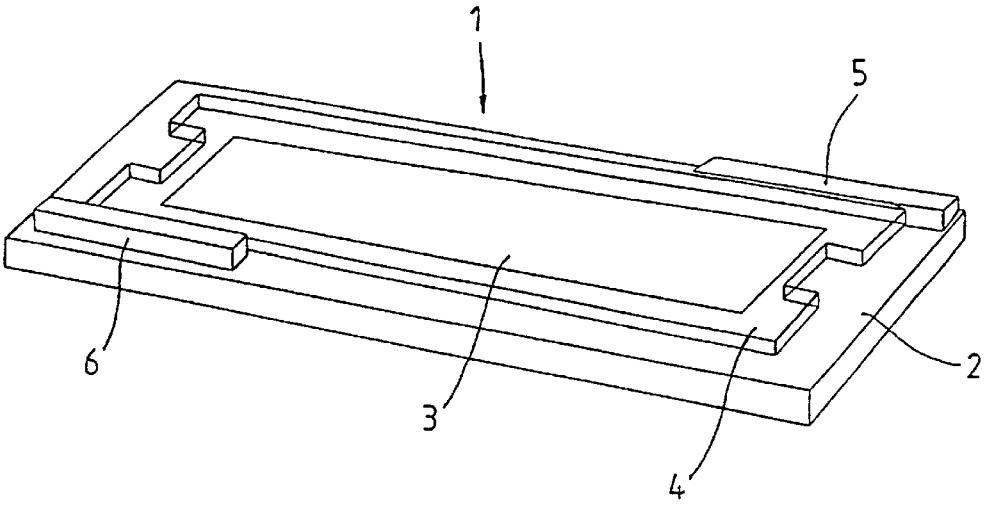
FIG. 1, a schematic perspective representation of one embodiment of an anti-theft element.
Figure 2:
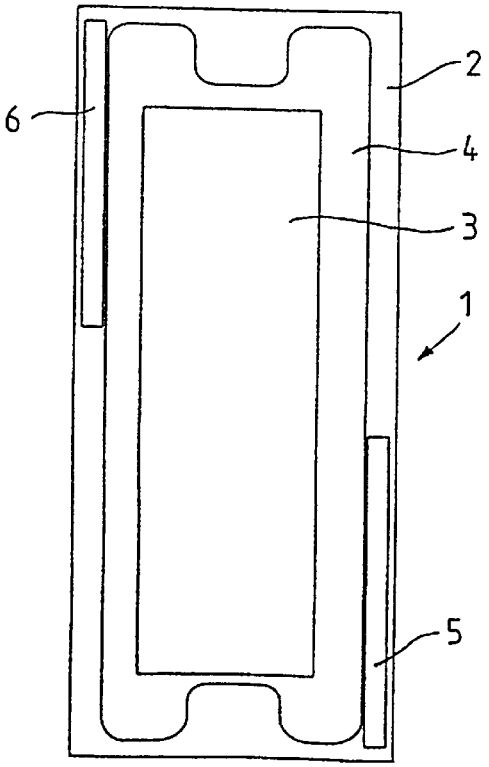
FIG. 2, a top view of the element according to FIG. 1.
Figure 3:
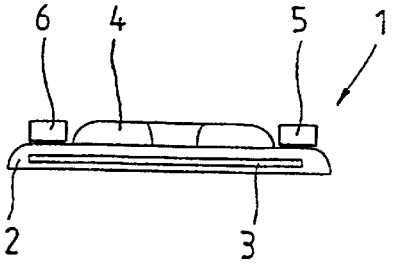
FIG. 3, a front view of the element according to FIG. 1.

FIGS. 1–3 show one embodiment of an anti-theft element 1. This element consists of a carrier 2, into which the metal plate 3, e.g., so-called Metglass, is inserted. FIG. 3 indicates that the carrier 2 has a cross section with rounded longitudinal edges.

A frame 4 is positioned on one surface of the carrier and preferably serves as an assembly aid.

The magnets 5 and 6 are arranged such that they diagonally oppose one another. These magnets consist of strips of a flexible foil with corresponding polarization.

The dimensions of the anti-theft element 1 essentially correspond to the dimensions of conventional anti-theft elements, i.e., the new anti-theft element can easily replace conventional anti-theft elements, namely without requiring any new devices.

The described embodiment serves for elucidating the invention, with the invention not being limited to the described embodiment.

LIST OF REFERENCE SYMBOLS

1 Anti-theft element
2 Carrier
3 Metal plate
4 Frame
5 Magnet
6 Magnet

What is claimed is:

1. An anti-theft element for use with acoustomagnetic anti-theft systems comprising:

a housing containing said anti-theft element, a subassembly comprising a magnet element and a thin metal plate, said subassembly being arranged within said housing, wherein said magnetic element is formed from two polarized flexible magnetic foils being aligned in a north pole or a south pole direction, respectively, and wherein said polarized flexible magnetic foils are placed at opposite sides of said anti-theft element.

2. Anti-theft element according to claim 1, characterized by the fact that the foil has a height of 1.4 mm, a length of 1.5 cm and a width of approximately 2 mm.

3. Anti-theft element according to claim 1, characterized by the fact that the foil strips which are magnetized with a north pole alignment and a south pole alignment and the metal plate are adjusted to a resonance of approximately 58 kHz.

4. Anti-theft element according to claim 2, characterized by the fact that the foil strips which are magnetized with a north pole alignment and a south pole alignment and the metal plate are adjusted to a resonance of approximately 58 kHz.

5. Anti-theft element according to claim 1, characterized by the fact that the anti-theft element is accommodated in a housing with dimensions that correspond to conventional AM labels.

6. Anti-theft element according to claim 2, characterized by the fact that the anti-theft element is accommodated in a housing with dimensions that correspond to conventional AM labels.

7. An anti-theft element for use with acoustomagnetic anti-theft systems comprising:

a label housing, a non-magnetized thin metal plate located in said label housing;

a first magnet strip having a north pole alignment, a second magnet strip having a south pole alignment, wherein the first magnet strip is located on a side of the label housing that is diagonally opposite of the location of the second magnet strip.

* * * * *